US005174132A

United States Patent [19]

Brandani

[11] Patent Number: 5,174,132

[45] Date of Patent: Dec. 29, 1992

[54] DETERMINING THE SIZE OF THE STITCH LOOPS IN STOCKING PRODUCTION MACHINES

[75] Inventor: Paolo Brandani, Scandicci, Italy

[73] Assignee: Savio S.p.A., Pordenone, Italy

[21] Appl. No.: 598,166

[22] Filed: Oct. 16, 1990

[30] Foreign Application Priority Data

Oct. 19, 1989 [IT] Italy ..... 22066 A/89

[51] Int. Cl.[5] ..... D04B 9/46

[52] U.S. Cl. ..... 66/54; 66/232

[58] Field of Search ..... 66/54, 55, 231, 232, 66/56, 27, 17

[56] References Cited

U.S. PATENT DOCUMENTS

| | | | |
|---|---|---|---|
| 4,527,402 | 7/1985 | Swallow et al. | 66/55 |
| 4,567,737 | 2/1986 | Lonati | 66/55 |
| 4,712,390 | 12/1987 | Lonati | 66/54 |
| 4,763,492 | 8/1988 | Tibbals, Jr. | 66/232 |
| 4,879,884 | 11/1988 | Bertagnoli | 66/54 X |
| 4,934,161 | 6/1990 | Güell | 66/54 |
| 4,953,400 | 9/1990 | Bossuyt | 66/54 X |
| 5,016,449 | 5/1991 | Negri | 66/54 |

FOREIGN PATENT DOCUMENTS

| | | |
|---|---|---|
| 3232643 | 3/1984 | Fed. Rep. of Germany . |
| 2193230 | 2/1988 | United Kingdom . |

*Primary Examiner*—Andrew M. Falik
*Assistant Examiner*—John J. Calvert
*Attorney, Agent, or Firm*—George P. Hoare, Jr.

[57] ABSTRACT

An automatic method for adjusting the relative height between a needle cylinder and a stitch forming cam of an automatic knitting machine. A control means stores information for each different type of yarn that the machine might use. This information consists of a relative height for each of two different widths of the item being knitted. Using these two pairs of numbers, the proper relative height for any given width can be calculated using a linear equation. As a stocking is automatically knitted, and different zones of the stocking are produced, the proper relative height is calculated using the stored information, eliminating the need for manual adjustment of either the needle cylinder or the stitch forming cam.

6 Claims, 2 Drawing Sheets

DETERMINING THE SIZE OF THE STITCH LOOPS IN STOCKING PRODUCTION MACHINES

This invention relates to a method for determining by means of a control unit the size of the stitch loops in high-speed stocking production machines, and consequently the stocking transverse extensibility.

The width of the variation involved in forming a stocking is adjusted by varying the height position of the cylinder (or of the stitch formation cams). As the sinkers are also moved vertically thereby whereas the needles remain in the path determined by the relative control cams, it is possible by this means to vary the depth to which the needle descends below the sinker knock-over plane, and consequently the yarn length absorbed by each stitch loop.

The position of the cylinder in terms of its height is adjusted by the stepper motor.

In the current state of the art, the height adjustment is done by the operator making various attempts on the basis of his experience.

The basic parameters concerned in said determination are the type of yarn, while leaving the number of needles and yarn speed constant.

We have now found a method which enables the optimum height to be determined by using a control unit utilizing an algorithm, so reducing the time involved in the determination and at the same time making the stocking production machine more reliable in that the margin of operator error is reduced.

The method of the present invention for determining the stitch loop size in stocking production machines by means of a control unit comprises the following stages:

storing in the control unit information which for every type of yarn with which a stocking zone is to be produced represents two pairs of values, each pair of values consisting between a height of the stitch forming cylinder and the stitch forming cams, and the corresponding stocking width;

selecting the width of the stocking zone and the type of yarn for each stocking zone, to consequently determine for each stocking zone, by means between the control unit, the height of the stitch forming cylinder and the stitch forming cams on the basis of the following straight-line equation:

$$\frac{h - h_1}{h_2 - h_1} = \frac{l - l_1}{l_2 - l_1} \quad (1)$$

where l is the selected width, $(h_1, l_1)$ and $(h_2, l_2)$ are the two pairs of values, and h is the cylinder height;

measuring the rotational speed and the angular position of the cylinder and feeding this information to the control unit;

then feeding the commands to the stepper motor by means of the control unit.

Figure 1:
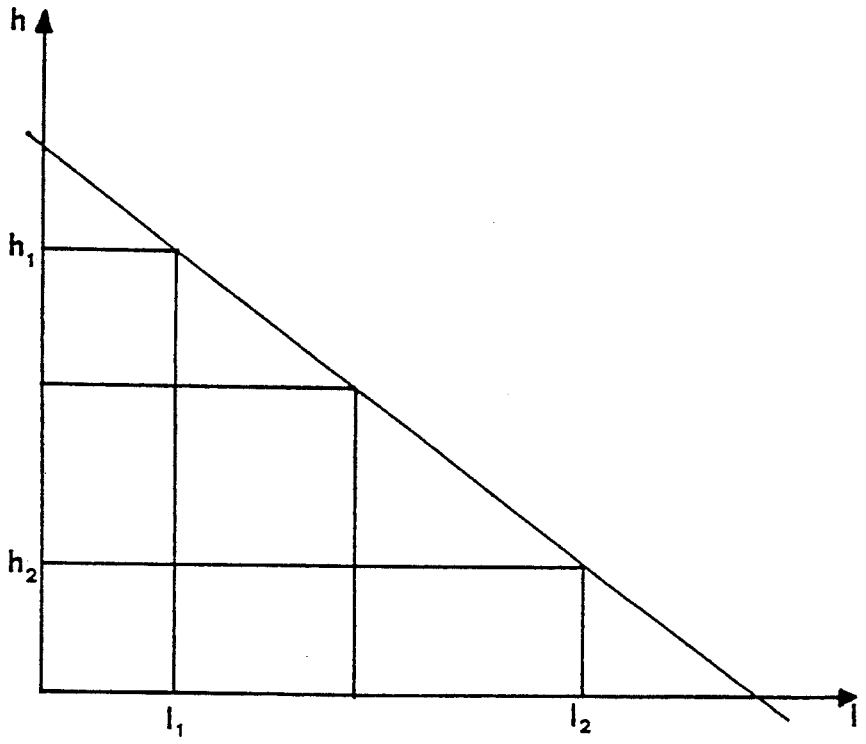
FIGS. 1 and 2 are graphs representing a straight line equation and changes necessitated by the equation.

Experimental measurements have shown that the relationship between the cylinder height and stocking width is linear, in accordance with the graph of FIG. 1, in which the width is measured in centimeters and the cylinder height in the number of pulses to the contracting motor.

An analytical representation of this relationship can be obtained as a first approximation (which has proved sufficient in application) by measuring the stocking width corresponding to two different cylinder heights.

Let $(l_1, h_1)$ and $(l_2, h_2)$ be the coordinates of the points in the plane (l, h) of FIG. 1 corresponding to these experimental measurements.

The equation of the straight line passing through these points is given by:

$$\frac{h - h_1}{h_2 - h_1} = \frac{l - l_1}{l_2 - l_1} \quad (1)$$

which, by putting $\Delta l = l_2 - l_1$ and $\Delta h = h_2 - h_1$ can be rewritten as $$h = \frac{\Delta h}{\Delta l}(l - l_1) + h_1 \quad (2)$$

This equation provides the functional relationship between the cylinder height and the sought stocking with This relationship is generally different for each zone, and the stated experimental measurements must therefore be repeated for each stocking zone.

A PASCAL function has been developed for determining the height corresponding to a certain width. This function is based on a knowledge of the experimental data $(l_1, h_1)$ and $(l_2, h_2)$ and operates on the generic width l to provide the corresponding height h in accordance with equation (2).

To avoid using the library of floating point functions for the PASCAL compiler utilized, the calculations relating to equation (2) have been organized so as to use only integer arithmetic. From (2):

$$h = \frac{\Delta h(l - l_1) + h_1 \Delta l}{\Delta l} = \frac{N}{\Delta l} \quad (3)$$

The numerator N of equation (3) obviously gives an integer, the quotient $N/\Delta l$ being obtained by a rounding-up operation in accordance with the following algorithm:

$$\begin{aligned} \text{round}(N/\Delta l) &= trunc\{(N/\Delta l) + 0.5\} \\ &= trunc\{(2N + \Delta l)/2\Delta l\} \\ &= (2N + \Delta l) div (\Delta l) \end{aligned}$$

where round indicates the rounding-up operation, trunc the truncation operation and div the integer division. It will be noted that the PASCAL round function has not been used as this forms part of the floating-point arithmetic library.

The number of pulses calculated in this manner for feeding to the contracting motor is "saturated" at the maximum number of pulses which can be actually fed to this motor (mechanical constraint). The width-height conversion function in PASCAL is as follows:

```
{width->height conversion function}
function converti(i:byte;width:word):word;
var
```

-continued

```
        num.deltal.deltah:integer;
        convl : word;
    begin
      with actart.zonea[i] do
      begin
        convl:=maxstepr;
        deltal:=ctl2-ctl1;
        deltah:=cth2-cth1;
        if deltal<>0 then
        begin
          num:=deltah*width+cth1*deltal-ctl1*deltah;
          convl:=(2*num+deltal)div(2*deltal);
          if convl < 0 then convl:=1;
          if convl > maxstepr then convl:=maxstepr;
          converti:=convl;
      end
      else begin
              error=16#50;    (width setting error by editor)
              converti:=convl  (set converti to a valid value)
            end;
    end;
end;
```

in which i=current zone width=programmed width ctl1=Width calibration coefficient 1 ($l_1$)

ctl2=Width calibration coefficient 2 ($l_2$)

cth1=Height calibration coefficient 1 ($h_1$)

cth2=Height calibration coefficient 2 ($h_2$)

The method of the present invention also enables the various heights of shaped zones of the stocking to be determined. In this respect it can often happen that the width of a stocking zone instead of remaining constant has to decrease. This is currently done by the operator intervening every given number of revolutions to increase the height, but this gives rise to a more or less evident "step effect".

Using the aforesaid method, two widths, namely the major and the minor, are chosen for each shaped zone, the control unit then determining the corresponding initial and final height by means of equation (1), the intermediate heights being extrapolated by the control unit by means of an algorithm which progressively varies the width.

In this manner the cylinder height could be varied to the limit between one rotational speed and another.

The present invention also relates to the procedure for if necessary correcting the programmed width for individual stocking zones.

The width obtained for a non-shaped zone or for straight portions of shaped zones of the stocking is measured, and if this differs from the (previously selected) programmed width, the relative height between the cylinder and the stitch formation cams is changed by an algorithm representing a straight line having the same gradient as the straight line of equation (1) but passing through a point having the measured width and the previously set height as its coordinates. A new height for the previously selected width is then determined in the aforesaid manner.

Figure 2:
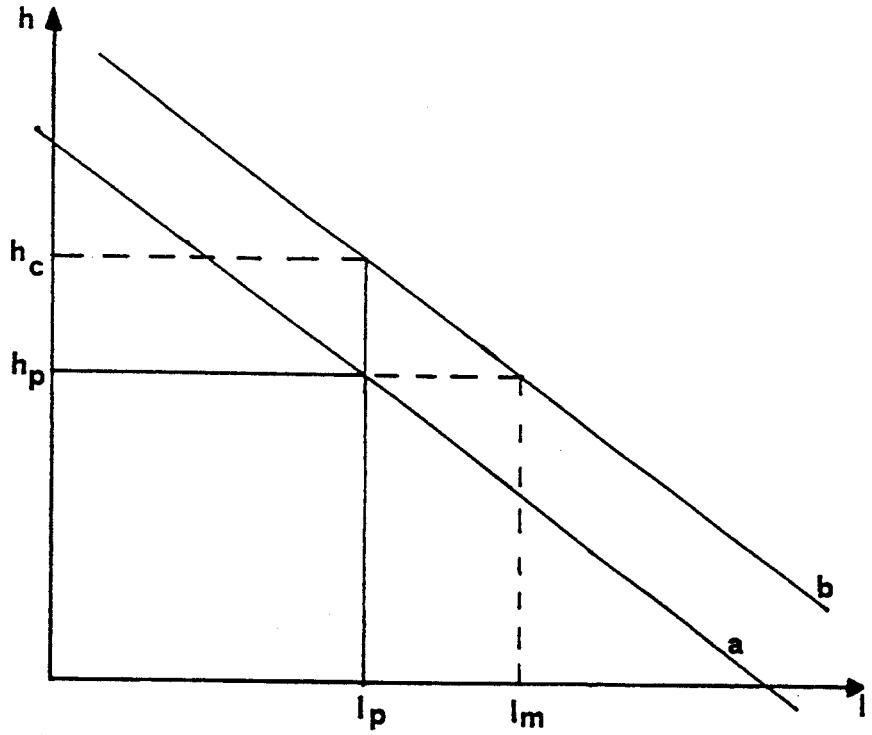

To illustrate the control and possible correction procedure reference will now be made to the graph of FIG. 2.

The straight line (a) is the straight line calculated from equation (1). For a given programmed width ($l_p$) it provides a corresponding height ($h_p$).

Upon a checking operation, a width ($l_m$) other than the programmed one is measured.

A new working straight line (b) must then be used which is parallel to the preceding and passes through the point B ($l_m$, $h_p$), to thus determine a new corresponding height ($h_c$) for obtaining the programmed width ($l_p$).

A programme in PASCAL language is given below, representing a particular method for correcting from the keyboard.

```
{data adaptation procedure for stepper motors}
procedure adapt(var actart:article;var actsize:size);
  if flgepsil then
    dat_stzone[k].epsil:={(dat_stzone[k].prg_width+dat_stzone[k].
    epsil)-dat_stzone[k].meas_width);
      newwidth:=dat_stzone[k].prg_width+dat_stzone[k].epsil;
      dat_stzone[k].meas_width:=dat_stzone[k].prg_width;
      actsize.zonet[i].shapes[j].initialwidth:=newwidth;
      actsize.zonet[i].shapes[j ]. fin alwidth:=newwidth;
      if ((actsize.zonet[i].shapes[j+1].initialwidth <>
        actsize.zonet[i].shapes[j+1].finalwidth) and
        (j < actsize.zonet[i].nshape)) then
        actsize.zonet[i].shapes[j+1].initialwidth:=newwidth;
      j:=j+1;      }
      k:=k+1;
    end;
    j:=j+1;
  until ((k=n_stzone+1) or (j=actsize.zonet[i].nshape+1));
end
else
begin
  if flgespsil then
    dat_stzone[1].epsil:={(dat_stzone[1].prg_width+dat_stzone[1].
    epsil)-dat_stzone[1].meas_width);
    newwidth:=dat_stzone[1].prg_width+dat_stzone[1].epsil;
    actsize.zonet[i].initialwidth:=newwidth
    dat_stzone[1].meas_width:=dat_stzone[1].prg_width;
  end;
end;
end;
```

Figure 3:
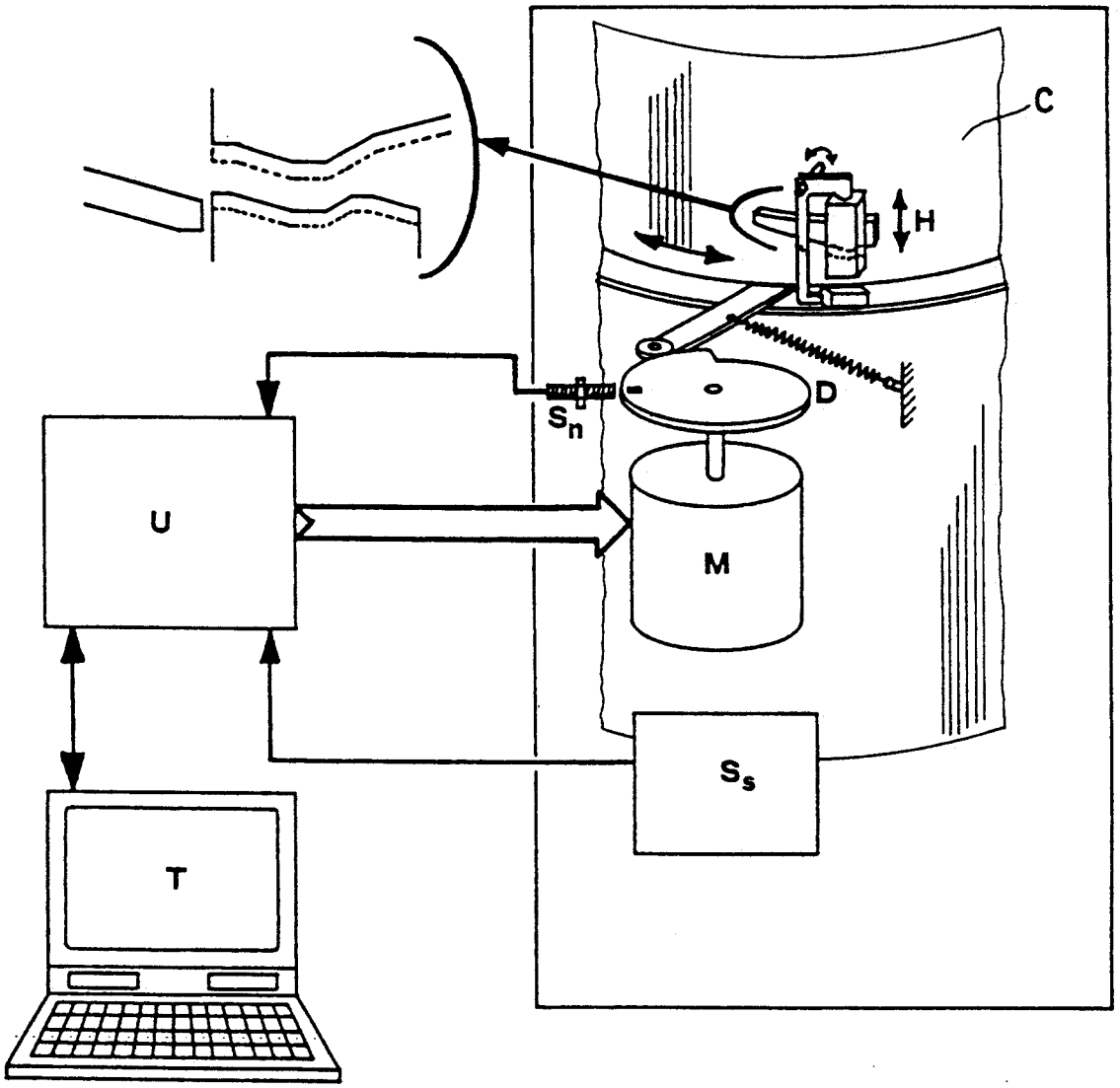
FIG. 3 is a representation of the method flow according to the invention.

The operation of the invention is as follows, with reference to FIG. 3.

The control unit (U) is supplied with the parameters from the terminal (T), the "zero" reference of the disc D by the sensor ($S_n$) and the information regarding the cylinder-machine synchronism by the sensor ($S_s$).

The control unit feeds commands to the stepper motor (M), on the output shaft of which there is fixed a disc (D) which by a lever system varies the height (H) of the cylinder (C).

I claim:

1. In an automatic knitting machine having a plurality of zones, a needle cylinder, and a stitch forming cam, a method of adjusting the relative height between the cylinder and the cam in a corresponding zone for varying the stitch loop size, wherein the machine has a control unit and a step motor operatively connected therewith for adjusting the relative height, and wherein the method comprises:

a) storing two pairs of values in the control unit for each of a plurality of different types of yarns with which each zone is to be produced, wherein each pair of values includes the relative height and a corresponding width;

b) selecting a width and a type of yarn for each zone to be produced;

c) determining the relative height corresponding to said selected width and said selected type of yarn for each zone by means of the control unit using the following equation:

$$\frac{h - h_1}{h_2 - h_1} = \frac{l - l_1}{l_2 - l_1}$$

wherein ($h_1$, $l_1$) and ($h_2$, $l_2$) are the two pairs of values associated with said selected type of yarn, l is said selected width, and h is the relative height;

d) measuring the rotational speed and angular position of the cylinder and feeding said speed and said position to the control unit; and e) activating the stepped motor by means of the control unit thereby adjusting the relative height between the cylinder and the cam to correspond to the relative height (h) calculated in said determining step.

2. The method of claim 1, wherein at least one zone has a width differing from other zones, and wherein said at least one zone has a major width and a minor width, wherein said selection step includes selecting the major width and the minor width, said determining step includes determining the relative height corresponding to said selected major width and said selected minor width, and wherein intermediate heights are determined by extrapolation using the relative heights determined for said selected major and minor widths.

3. The method of claim 1, further comprising:

measuring the width of a zone on a knitted product, comparing said measured width with the stored corresponding width;

adjusting the stored pairs of values with a new pair of values when the measured width of a zone differs from the stored width, wherein the new pair of values includes said determined relative height and said measured width.

4. In an automatic knitting machine having a plurality of zones, a needle cylinder, and a stitch forming cam, a method of adjusting the relative height between the cylinder and the cam in a corresponding zone for varying the stitch loop size, wherein the machine has a control unit and a step motor operatively connected therewith for adjusting the relative height, and wherein the method comprises:

a) storing two pairs of values in the control unit for each of a plurality of different types of yarns with which each zone is to be produced, wherein each pair of values includes the relative height and a corresponding width;

b) selecting two pairs of values corresponding with two different relative heights, and a type of yarn for each zone to be produced;

c) determining the width corresponding to said selected two pairs of values and said selected type of yarn for each zone by means of the control unit using the following equation:

$$\frac{h - h_1}{h_2 - h_1} = \frac{l - l_1}{l_2 - l_1}$$

wherein ($h_1$, $l_1$) and ($h_2$, $l_2$) are the two pairs of values associated with said selected type of yarn, l is said selected width, and h is the relative height;

d) measuring the rotational speed and angular position of the cylinder and feeding said speed and said position to the control unit; and e) activating the stepped motor by means of the control unit thereby adjusting the relative height between the cylinder and the cam to correspond to the relative height (h) calculated in said determining step.

5. The method of claim 4, wherein at least one zone has a width differing from other zones, and wherein said at least one zone has a major width and a minor width, wherein said selection step includes selecting the major width and the minor width, said determining step includes determining the relative height corresponding to said selected major width and said selected minor width, and wherein intermediate heights are determined by extrapolation using the relative heights determined for said selected major and minor widths.

6. The method of claim 4, further comprising:

measuring the width of a zone on a knitted product, comparing said measured width with the stored corresponding width;

adjusting the stored pairs of values with a new pair of values when the measured width of a zone differs from the stored width, wherein the new pair of values includes said determined relative height and said measured width.

* * * * *